United States Patent [19]

Sun

[11] 4,251,004

[45] Feb. 17, 1981

[54] CONTAINERS

[75] Inventor: Kin C. Sun, Kowloon, Hong Kong

[73] Assignee: Kin Hip Metal & Plastic Factory Ltd., Kowloon, Hong Kong

[21] Appl. No.: 91,230

[22] Filed: Nov. 5, 1979

Related U.S. Application Data

[63] Continuation of Ser. No. 963,472, Nov. 24, 1978, abandoned.

[51] Int. Cl.[3] ..... B65D 6/00; B65D 8/04

[52] U.S. Cl. ..... 220/4 R; 220/4 A; 220/67; 220/76

[58] Field of Search ..... 220/4 R, 76, 75, 69, 220/67, 4 A; D7/64, 65

[56] References Cited

U.S. PATENT DOCUMENTS

| | | | |
|---|---|---|---|
| D. 179,705 | 2/1957 | Schnitzer | D7/64 |
| D. 184,715 | 3/1959 | Cornelius et al. | D7/65 |
| D. 236,180 | 8/1975 | Greger | D7/65 X |
| 2,254,164 | 8/1941 | Bernhardt | D7/65 |
| 2,327,412 | 8/1943 | Fink | 220/4 R |
| 2,545,577 | 3/1951 | Griffin | 220/4 A |
| 2,552,420 | 5/1951 | Frankel | 220/4 R X |
| 3,111,240 | 11/1963 | Whitton, Jr. | 220/67 |
| 3,138,698 | 6/1964 | Wells et al. | 220/67 X |
| 3,174,658 | 3/1965 | Wittenberg et al. | 220/75 X |
| 3,306,505 | 2/1967 | Serio | D7/65 X |
| 3,504,816 | 4/1970 | Weichsel | 220/4 X |
| 3,881,625 | 5/1975 | Davolt | 215/329 |

*Primary Examiner*—Steven M. Pollard
*Attorney, Agent, or Firm*—Ladas & Parry

[57] ABSTRACT

A container for liquids having a cup-shaped base portion made of metal, and a shell portion permanently secured at its lower edge in liquid-tight manner to the upper edge of the base portion, the shell portion being made of a plastic material and being at least partially transparent or translucent.

8 Claims, 1 Drawing Figure

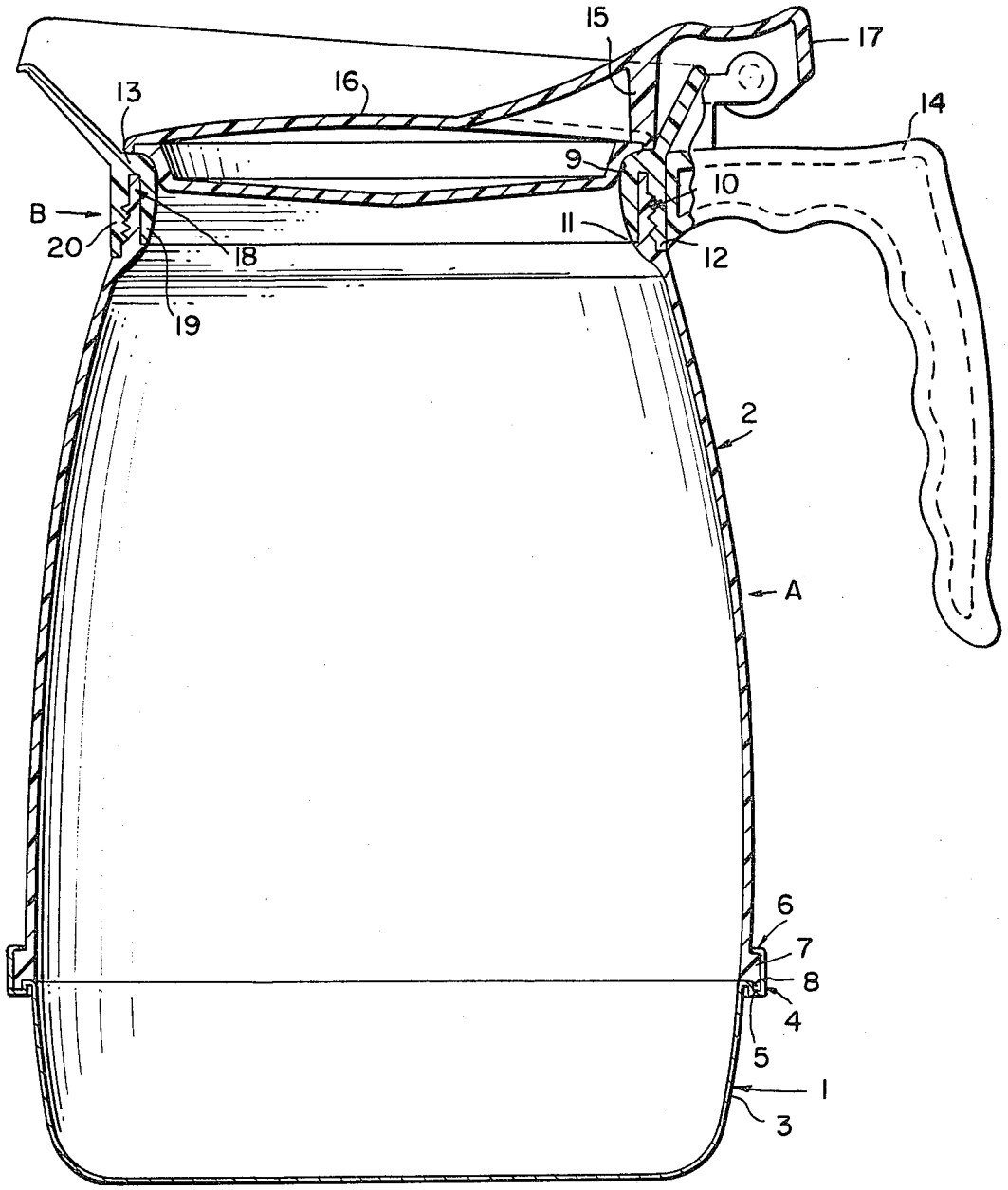
15
17
13
16
14
9
10
B
20
18
11
12
19
2
A
6
7
8
4
5
1
3

CONTAINERS

This is a continuation, of application Ser. No. 963,472 filed Nov. 24, 1978, now abandoned.

This invention relates to containers for liquids, such as jugs, and more particularly but not in any limiting sense to containers for use as coffee percolators.

Hitherto, conventional containers for use with hot liquids have usually had at least a major body portion made entirely of glass, for the advantage of visibility of the contents, or made entirely of metal or an opaque ceramic or other material, for the advantage of strength and unbreakability. Where the major body portion has been made of glass there has always been a serious drawback that such material is relatively fragile and is subject to breakage, particularly at the base which comes into contact with heat and is most likely to be struck against other objects when the container is in use. Whilst the use of metal, or strong ceramic, avoids this difficulty of breakage, it does not permit the desirable visibility of the contents of the container.

It is accordingly the object of the present invention to provide an improved jug which combines the advantages of being at least partially transparent and at least partially made of an unbreakable material.

According to the present invention a container for liquids comprises a cup-shaped base portion made of metal, and a shell portion permanently secured at its lower edge in liquid-tight manner to the upper edge of the base portion, the shell portion being made of a plastics material and being at least partially transparent or translucent.

The liquid-tight securing of the lower edge of the shell portion to the upper edge of the base portion is preferably obtained by engagement of a rib on the lower edge of the shell portion within recessing bounded by a flange at the upper edge of the base portion, the shaping of the interfitting portions being such that the shell portion is locked against movement both vertically and laterally with respect to the base portion.

In a convenient form of construction, the flange of the base portion defines a recess which opens upwardly, and an inturned lip which is spaced above and is opposed to the recess, the rib of the shell portion engaging into the recess, and between the recess-defining zone of the flange and its lip, whereby the shell portion is locked by the recess-defining zone and the intermediate portion of the flange against lateral movement.

The shell portion may have a throat and handle assembly removably mounted thereon. Preferably the engagement between the assembly and the shell portion is made liquid-tight. In a preferred form of construction, the assembly defines a recess into which a neck on the shell portion is engaged by screw-threading. For better sealing, the shell portion may have two shoulders, one inside the neck and the other outside the neck, to receive in abutment the lower end of inner and outer walls of the assembly.

A container according to the present invention will now be described, by way of example, with reference to the accompanying drawing which is a sectional elevation.

In the drawing there is shown a percolator container or jug having a main body portion "A" and a lid and handle assembly "B". The main body portion "A" is composed of a metal base portion 1 and an upper transparent plastics shell 2. The base portion 1 is cup-shaped, with an upstanding wall 3 at the upper edge of which is formed a flange 4 which presents an internal recess 5. Opposite to the recess 5, and above it, is an inturned lip 16. It will be appreciated that the shaping of the flange 4 is continued about the whole circumference of the wall 3.

The plastics shell 2, made for example of polycarbonate material in crystal transparent finish and substantially unbreakable, has at its lower edge a radially outwardly projecting rib 7 which is adapted to seat into the space defined between the recess 5 and the lip 6, and which incorporates a depending bead 8 to seat into the recess 5. By this means, the shell 2 and the base portion 1 are securely locked together and cannot move relatively either laterally or vertically. Moreover, the engagement between the rib 7 and the flange 4 is such that the connection between the two is liquid tight.

At its upper end, the shell 2 has a neck 9 which is externally screw-threaded as at 10, and two shoulders 11 and 12 are formed one at the inside and one at the outside of the neck.

The lid and handle assembly "B" is a two-piece assembly of a throat 13 and integral handle 14, on which is pivotably mounted an arm 15 carrying a lid 16. The arm 15 is continued outwardly to form a knob 17 for actuation with the thumb to lift the lid. At its lower part, the throat 13 has a recess 18 defined between an inner wall 19 and an outer wall 20, and the neck 9 of the shell is received as a fluid-tight push fit in the recess 18. The inner face of the outer wall 20 is screw-threaded for engagement of the throat portion 13 onto the shell 2. When the two parts are fully engaged by the screw-threading, the lower end of the outer wall 20 abouts on the shoulder 12, and the lower end of the inner wall 19 abuts on the shoulder 11, in sealing engagement. The lid and handle assembly could be made, for instance, of opaque polycarbonate plastics material. The base 1 could be made, for instance, of stainless steel.

With such a construction, the entire container is substantially unbreakable under any normal usage short of deliberate destruction. The base is normally subjected to most blows when in use, and this is made of strong metal. The plastics portions, e.g. of polycarbonate are also capable of standing up to steam heat, under pressure, at 125° C. (260° F.), and are stain-resistant and odorless. The whole of the shell 2 is transparent and the advantage is thus obtained of having a container which, although permitting through vision, is nevertheless substantially unbreakable.

I claim:

1. A container for liquids comprising a cup-shaped base portion made of metal, and a shell portion permanently secured at its lower edge in liquid-tight manner to the upper edge of the base portion, the shell portion being made of plastic material and being at least partially transparent or translucent, the shell portion being secured to the base portion by an external annular rib with a downwardly facing lip on the lower edge of the shell portion fully engaged within an annular recess bounded by a flange at the upper edge of the base portion, the interfitting portions being shaped such that the shell portion is locked against movement both vertically and laterally with respect to the base portion by the flange of the base portion defining a recess which opens upwardly and an inturned lip which is spaced above the recess with the rib of the shell portion engaged in the recess between the recess-defining zone of the flange and its lip, the shell portion having an upper edge having a throat and handle assembly removably mounted in liquid tight manner thereon, the handle assembly defining an annular downwardly facing recess into which a neck on the shell portion is engaged by screw-threading, the shell portion having two nesting upwardly facing shoulders, one inside the neck and the other outside the neck, to receive an abutment the lower end of inner and outer walls of the assembly defining said downwardly facing recess, whereby liquid leakage between the metal base, shell and assembly as a result of deferential thermal expansion of the materials, as a result of changes in temperature is prevented.

2. A container for liquids, as claimed in claim 1, wherein for securing of the shell portion to the base portion a rib on the lower edge of the shell portion is engaged within a recess bounded by a flange at the upper edge of the base portion, the shaping of the interfitting portions being such that the shell portion is locked against movement both vertically and laterally with respect to the base portion.

3. A container for liquids, as claimed in claim 2, wherein the flange of the base portion defines a recess which opens upwardly, and an inturned lip which is spaced above and is opposed to the recess, the rib of the shell portion engaging into the recess, and between the recess-defining zone of the flange and its lip.

4. A container for liquids, as claimed in claim 1, wherein the shell portion has a throat and handle assembly removably mounted thereon.

5. A container for liquids, as claimed in claim 4, wherein the engagement between the throat and handle assembly, and the shell portion is made liquid-tight.

6. A container for liquids, as claimed in claim 4, wherein the assembly defines a recess into which a neck on the shell portion is engaged by screw-threading.

7. A container for liquids, as claimed in claim 6, wherein the shell portion has two shoulders, one inside the neck and the other outside the neck, to receive in abutment the lower end of inner and outer walls of the assembly.

8. A container for liquids, as claimed in claim 1, wherein the shell portion is made of crystal transparent finish polycarbonate plastics material.

* * * * *